United States Patent [19]

Heise et al.

[11] Patent Number: 4,870,256

[45] Date of Patent: Sep. 26, 1989

[54] GRAPHITE HOLDING ELEMENTS FOR HEATING BARS IN INDUSTRIAL FURNACES

[75] Inventors: Wolfgang Heise, Erlensee; Georg Kell, Frankfurt am Main; Rolf Schuster, Hanau, all of Fed. Rep. of Germany

[73] Assignee: Degussa Aktiengesellschaft, Frankfurt, Fed. Rep. of Germany

[21] Appl. No.: 201,727

[22] Filed: Jun. 3, 1988

[30] Foreign Application Priority Data

Jun. 6, 1987 [DE] Fed. Rep. of Germany ..... 3719045

[51] Int. Cl.[4] ..... H05B 3/66

[52] U.S. Cl. ..... 219/542; 373/128

[58] Field of Search ..... 219/342, 352, 355, 542, 219/536; 373/112, 114, 125, 128, 130, 133

[56] References Cited

U.S. PATENT DOCUMENTS

| | | | |
|---|---|---|---|
| 3,395,241 | 7/1968 | Roman | 373/128 |
| 4,180,697 | 12/1979 | Schumann | 373/132 |
| 4,429,403 | 1/1984 | Hooper | 373/128 |

*Primary Examiner*—A. D. Pellinen
*Assistant Examiner*—Leon K. Fuller
*Attorney, Agent, or Firm*—Beveridge, DeGrandi & Weilacher

[57] ABSTRACT

A holding element for heating bars in industrial furnaces must be as flexible as possible so that it can accommodate the thermal expansion of the heating bars. Circular rings or circular-ring sectors provided with bores and made from a flexible graphite laminate plate are used for this purpose.

4 Claims, 1 Drawing Sheet

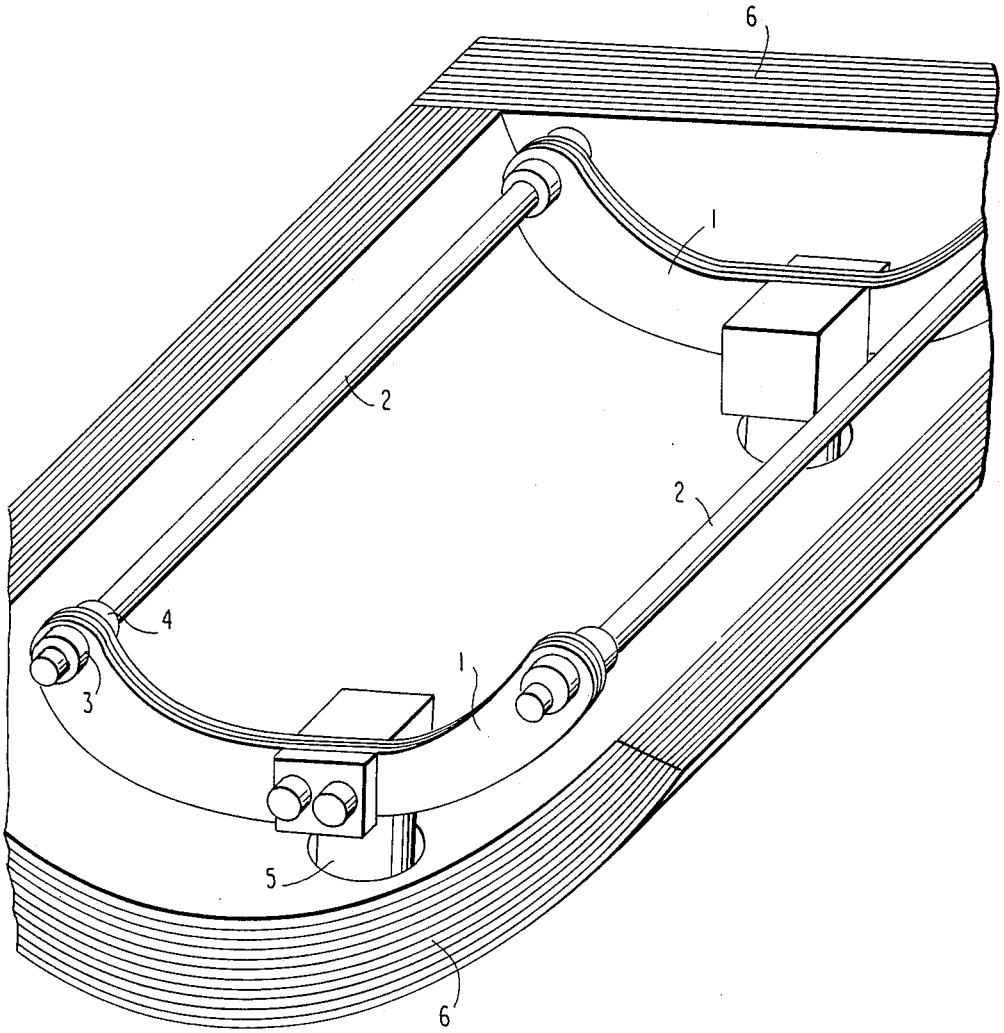
6
1
2
2
4
3
1
5
6

GRAPHITE HOLDING ELEMENTS FOR HEATING BARS IN INDUSTRIAL FURNACES

INTRODUCTION AND BACKGROUND

The present invention relates to graphite holding elements for heating bars in industrial furnaces.

In industrial furnaces, more particularly in protective-atmosphere and vacuum furnaces, graphite heating bars are used as heating elements. Preferably, the heating bars are formed as graphite tubes, which are disposed axially in the direction of the furnace axis and distributed at equal intervals along the furnace circumference. For fastening and for current supply, the heating bars are each held in their central region in a boltable graphite block. This type of fastening has the advantage that, as they heat up, the graphite bars can expand freely toward the end faces of the furnace. The current flows from heating bar to heating bar via fittings formed of either graphite U-tubes or solid graphite members.

In certain types of industrial furnaces, the graphite heating bars must, because of structural and thermal conditions, be fastened at each of their ends, i.e., near the end faces of the furnace chamber. Again, graphite blocks can be used as fastening elements.

Graphite rings or graphite rings divided into several sectors (if the graphite heating bars are connected in parallel) are also used. Blocks and rings provide mechanical fastening as well as electrical supply. However, this causes the heating bars to be firmly clamped at both ends. Thus, the thermal linear expansion of the heating tubs often causes the graphite rings to break.

SUMMARY OF THE INVENTION

Therefore, it is an object of the present invention to develop, for heating bars in industrial furnaces, graphite holding bars that are capable of accommodating thermal expansion of the heating bars during furnace operation without breaking and which, at the same time, have good electrical conductivity.

The above and other objects are achieved by the invention by providing circular rings or circular-ring sectors that have appropriate bores and consist of a flexible graphite laminate plate, with the laminate lay-up being oriented perpendicularly toward the axis of the heating bar. The laminate is composed of a plurality of graphite lamina.

BRIEF DESCRIPTION OF DRAWING

The drawing shows a schematic representation of the holding element in accordance with the invention.

DETAILED DESCRIPTION OF THE INVENTION

With reference to the drawing, there is shown a schematic perspective view of an exemplary embodiment of the graphite holding element of the present invention. As shown, two heating elements or rods (2) are each fastened and secured at each end thereof in a holding element (1) formed of a graphite laminate by means of a nut (3) and counter nut (4). The holding element (1) is provided with bores to accommodate the heating rods. The holding elements (1) are fastened to the oven wall by graphite columns (5) which push through the chamber insulation (6). The sheet layer construction of the graphite laminate of the holder (1) is perpendicular to the axis of the heating rods. In the embodiment as shown in the drawing the graphite laminate holding element is arcuate in shape and is provided with two bore holes; one at each distal end of the arcuate section. The laminate is also adjusted to be mounted on supporting columns (5).

The dimensions of the circular-ring sectors are so chosen that the height H of the circular-ring sectors is larger than the width B, measured along the axis of the heating bars. Preferably, $2 \leq H/B \leq 8$.

These holding elements of graphite laminate withstand the conditions of furnace operation and are sufficiently flexible to accommodate the thermal expansion of heating bars without thereby suffering a decrease in mechanical loadability. Moreover, their electrical conductivity is good, so they can also act as current conductors.

The holding elements are obtained by cutting appropriate rings out of commercial graphite laminate plates and, if necessary, dividing them into sectors, so that the sections of the heating bars can be heated independently of each other. The heating bars are fastened by means of appropriate bores in the holding elements. Preferably, fastening occurs by means of a nut and counter nut.

Since the specific electrical resistance in the direction of pressing of the graphite laminate is smaller by a factor 1/65 that that perpendicular to the direction of pressing, the laminate strips are cut in such a way that the direction of current flow coincides with the linear orientation of the laminate. Furthermore, since the specific electrical resistance of the graphite laminate in the layer direction is equal to that of solid graphite (approximately 10 ohm.micron), the electrical characteristics of the furnace are not altered.

Because the laminate lay-up of the anchoring conductive element is perpendicular to the direction of thermal expansion of the heating bars, the holding element is sufficiently flexible to withstand deflections of different magnitude and in a different direction at the clamping points of the heating bars.

By suitably choosing the cross section of the circular-ring sectors (consistent with the range of variation of H and B), the ohmic resistance of the sectors can be adjusted relative to the ohmic resistance of the heat conductors. Thus, the heating power supplied to the end faces of the furnace can be varied, i.e., the fastening elements as additional heating elements in the space occupied by the furnace.

Further variations and modifications of the foregoing will be apparent to those skilled in the art and are intended to be encompassed by the appended claims.

German priority application P 37 19 045.8 is incorporated herein.

We claim:

1. A graphite holding element for retaining and supporting a heating bar in an industrial furnace comprising a flexible graphite laminate plate provided with appropriate bore holes to receive and hold a heating bar, the layers of said laminate extending perpendicularly to the axis of the heating bar.

2. The graphite holding element as set forth in claim 1, wherein the element has a height H and a width B in the direction of the heating bar of the circular-ring sectors and is determined by the formula $2 \leq H/B \leq 8$.

3. The graphite holding element as set forth in claim 1 which is arcuate in shape and is provided with a bore hole at each end thereof adapted to hold said heating element rod.

4. A combination of graphite holding elements and heating elements adapted for insertion into an industrial furnace comprising at least a pair of graphite holding elements (1) connected to two heating bars (2), wherein said graphite holding element comprises a flexible graphite laminate plate provided with a bore hole at an end thereof, said heating-element being fastened into said bore hole, the graphite holding element comprises of a plurality of graphite lamina oriented perpendicular to said heating elements.

* * * * *